United States Patent [19]

Kuse

[11] Patent Number: 4,627,807

[45] Date of Patent: Dec. 9, 1986

[54] APPARATUS FOR MANUFACTURING SLIDE FASTENER WITH SEPARABLE END STOP

[75] Inventor: Kazuki Kuse, Toyama, Japan

[73] Assignee: Yoshida Kogyo K.K., Tokyo, Japan

[21] Appl. No.: 720,419

[22] Filed: Apr. 5, 1985

[30] Foreign Application Priority Data

May 10, 1984 [JP] Japan ..... 59-93278

[51] Int. Cl.[4] ..... B29D 5/02

[52] U.S. Cl. ..... 425/116; 29/33.2; 29/34 A; 29/767; 264/252; 425/122; 425/545; 425/814

[58] Field of Search ..... 425/113, 114, 116, 122, 425/545, 814, DIG. 34; 264/40.7, 251, 252, 273; 29/33.2, 34 A, 408, 410, 766, 767; 24/409

[56] References Cited

U.S. PATENT DOCUMENTS

| | | | |
|---|---|---|---|
| 2,543,111 | 2/1951 | Kuzmick | 264/252 X |
| 2,686,338 | 8/1954 | Morin | 425/814 X |
| 2,705,814 | 4/1955 | Feldmann | 264/252 X |
| 3,097,395 | 7/1963 | Yoshida | 425/545 X |
| 3,849,042 | 11/1974 | Anderegg | 425/814 X |
| 4,052,145 | 10/1977 | Stenhall | 425/814 X |
| 4,163,768 | 8/1979 | Stephens | 264/252 X |
| 4,222,723 | 9/1980 | Sawada | 425/116 |
| 4,336,220 | 6/1982 | Takahashi | 264/252 X |
| 4,368,570 | 10/1983 | Morita | 29/767 X |
| 4,492,547 | 1/1985 | Nogai | 425/122 X |

FOREIGN PATENT DOCUMENTS

| | | |
|---|---|---|
| 2709479 | 9/1977 | Fed. Rep. of Germany . |
| 90345 | 7/1977 | Japan . |
| 713108 | 8/1954 | United Kingdom . |

*Primary Examiner*—Richard L. Chiesa

*Attorney, Agent, or Firm*—Hill, Van Santen, Steadman & Simpson

[57] ABSTRACT

An apparatus of manufacturing a slide fastener with a separable end stop according to the invention includes: a step which is carried out while separating engaged stringers of continuous length which have space portions disposed at regular intervals in their longitudinal directions and which consists of conveying the separated stringers through an injection molding station; suspending the operation of conveying the stringers in such a manner that one of the space portions is disposed at the injection molding station; and simultaneously injection-molding upper stops and pins which constitute a separable end stop on the stringers at each end of the space portion. The improvement comprises a step, carried out prior to the injection molding step, of independently bending a portion of the tape which constitutes each of the stringers at the space portion within the injection molding station, whereby the respective portions of the stringers on both sides of the space portion are moved toward the center of the injection molding station and whereby end fastener elements at opposite ends of the space portion are respectively retained by stoppers which are made immovable relative to the injection molding station in terms of the moving direction of the stringers, thereby effecting positioning of the stringers.

3 Claims, 14 Drawing Figures

APPARATUS FOR MANUFACTURING SLIDE FASTENER WITH SEPARABLE END STOP

BACKGROUND OF THE INVENTION

1. Field of the Invention

The present invention relates to a method of and an apparatus for manufacturing a slide fastener with a separable end stop of the type in which stringers of continuous length which have space portions disposed at regular intervals in their longitudinal directions are intermittently conveyed and, during a suspension of the conveying operation, upper stops and pins which constitute a separable end stop are formed at each of the space portions by injection molding.

2. Description of the Prior Art

A method and an apparatus of this kind have heretofore been known in which a pair of engaged fastener stringers are separated while being conveyed, and each of the space portions of the stringers separated is stopped at an injection molding station where upper stops and pins which constitute a separable end stop, that is, a removable pin and a box pin, are simultaneously formed by injection molding at the opposite ends of the space portion. Such a method and apparatus have been disclosed in, for example, the specifications of Japanese Patent Laid-Open No. 90345/ 1977 (Laid-Open Date: July 29, 1977) and German Pat. Laid-Open No. 2,709,479 (Laid-Open Date: September 22, 1977). According to this known method and apparatus, errors in positioning the space portion directly lead to positional errors of the upper stops and the pins. Further, even if the position of the space portion is accurately regulated, the following problem still remains. The space portions per se involve variations in length and the degree of elongation of the tape which constitutes each of the stringers differs depending upon the force applied thereto and, therefore, all of these factors have a great effect on the potential for positional errors occurring with the upper stops and the pins. Furthermore, since the upper stops and the pins are simultaneously formed by injection molding, there is a need to employ an undesirably long runner for supplying a molten resin into cavities when forming the upper stops and the pins. This is uneconomical since an unnecessarily large amount of the resin is accordingly used. In addition, it is unfavorably necessary for dies of disadvantageously increased size to be used for the injection molding.

SUMMARY OF THE INVENTION

In view of the above-described disadvantages of the prior art, it is a primary object of the present invention to provide a method of and an apparatus for manufacturing a slide fastener with a separable end stop by which it is possible for sections employed for injection-molding the upper stops and the pins to come close to each other and to be positionally regulated with accuracy.

To this end, according to the invention, the arrangement is such that a portion of each of the stringer tapes at a space portion is independently bent at an injection molding station, thereby drawing the stringer tapes toward the center of the injection molding station, and in the course of this operation, end fastener elements at each end of the space portion are respectively engaged with stoppers which are made immovable in relation to the injection molding station, thereby effecting positioning of the stringers.

By virtue of the above-described arrangement, the present invention makes it possible to regulate the position of each of the end fastener elements at each end of the space portion irrespective of variations in the degree of elongation of the stringer tapes. Accordingly, the upper stops and the pins are injection-molded in a state wherein the relative positions between the upper stops and the pins and the above-described fastener elements are accurately regulated. Further, since the stringer tapes are drawn toward the center of the injection molding station in such a manner that the fastener elements at the opposite ends of each space portion come close to each other, it is advantageously possible to reduce the length and size of respective runners of the dies used for injection molding.

The above and other objects, features and advantages of the present invention will become clear from the following description of the preferred embodiment thereof, taken in conjunction with the accompanying drawings.

DESCRIPTION OF THE PREFERRED EMBODIMENT

Figure 1:
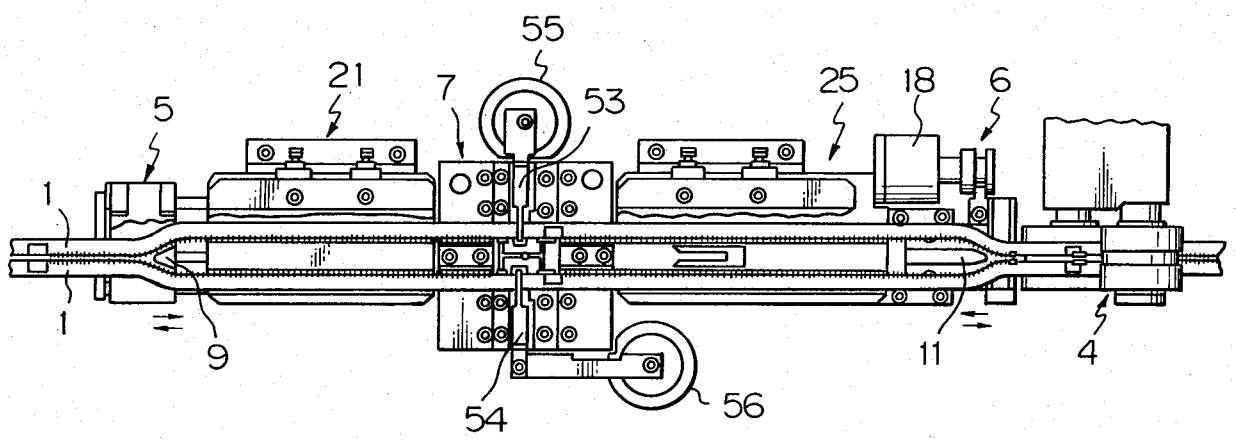
FIG. 1 is a top plan view of the apparatus according the present invention with a part thereof cut away for explanatory convenience.

Referring first to FIG. 1 which is a top plan view of one embodiment of the fastener manufacturing apparatus according to the present invention, in which a part of the apparatus is cut away for explanatory convenience, a pair of stringers 1 are fed from a roll-shaped supply source (not shown) through a pair of guide rollers 2 and a tension roller 3 (see FIG. 2) in a state wherein the stringers 1 are combined together by the engagement between their respective fastener element trains 14. The stringers 1 are intermittently advanced by two rollers which in combination constitute a conveyor device 4.

Figure 5:
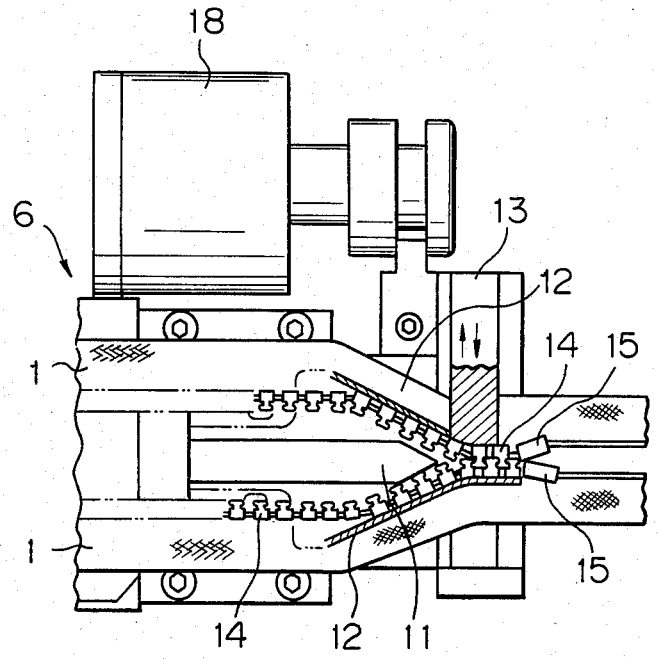
FIG. 5 is a top plan view of a stringer re-combining device in the apparatus according to the present invention.

The fastener manufacturing apparatus has a stringer separating device 5 on the upstream side and a stringer re-combining device 6 on the downstream side. The apparatus further has an injection molding station 7 located between the devices 5 and 6. The stringer separating device 5 has a wedge member 9 which is disposed in such a manner that the pair of stringers 1, as they are advanced, are split into two by the wedge member 9. The stringer re-combining device 6 has an inner guide member 11 and outer guide members 12 (see FIG. 5). The inner guide member 11 has a tapered distal end, while the outer guide members 12 are disposed in such a manner that they guide the fastener element trains 14 along the tapered distal end of the inner guide member 11. The arrangement is such that, as the respective fastener element trains 14 of the stringers 1 are passed through the area between these guide members, the fastener element trains 14 are re-engaged with each other. The terminating end of one of the outer guide members 12 is constituted by a movable guide member 13 which is pressed by the action of a spring (not shown) toward the fastener element trains 14 in such a manner that they are re-engaged with each other. The movable guide member 13 is movable upwardly as viewed in FIG. 5 by being pushed by upper stops 15 which are molded in a step, such as that which will be explained later, whereby the movable guide member 13 permits passage of the upper stops 15.

Figure 2:
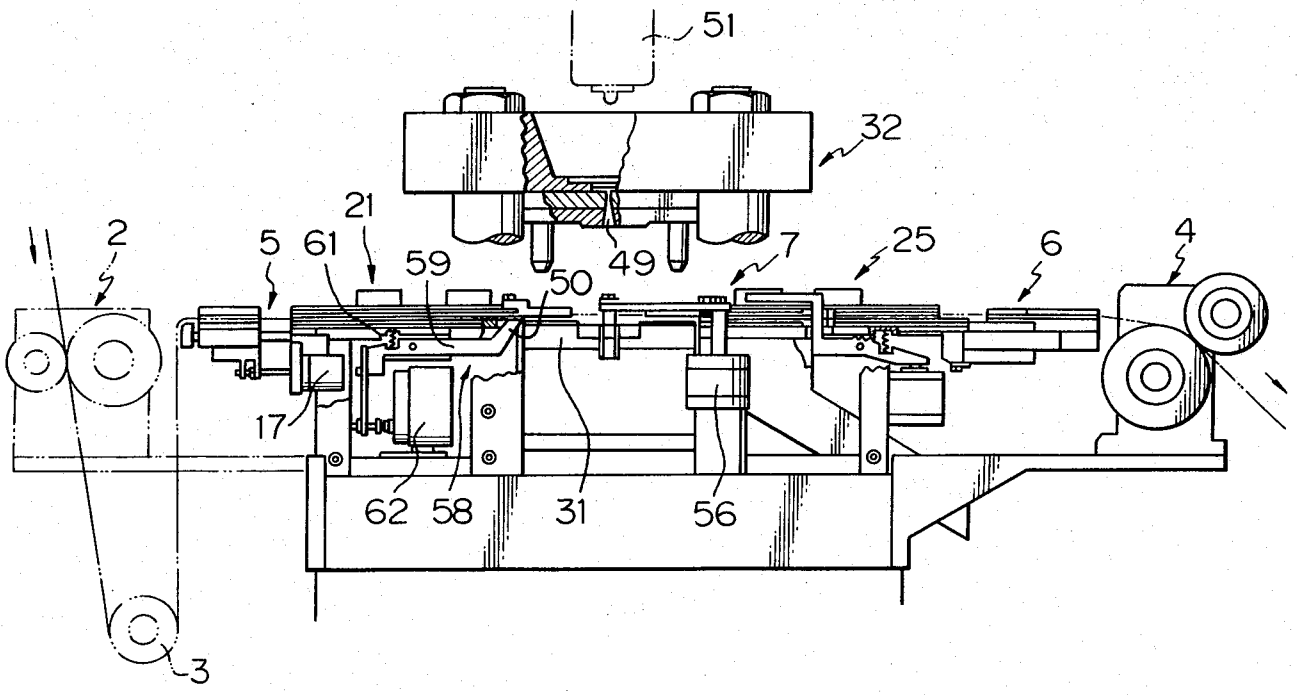
FIG. 2 is a side elevational view of the apparatus shown in FIG. 1.

The stringer separating device 5 is movable in the moving direction of the stringers 1 by the action of an air cylinder 17 (see FIG. 2). The stringer re-combining device 6 is similarly movable in the direction parallel with the moving direction of the stringers 1 by the action of an air cylinder 18 (see FIG. 1).

Figure 3:
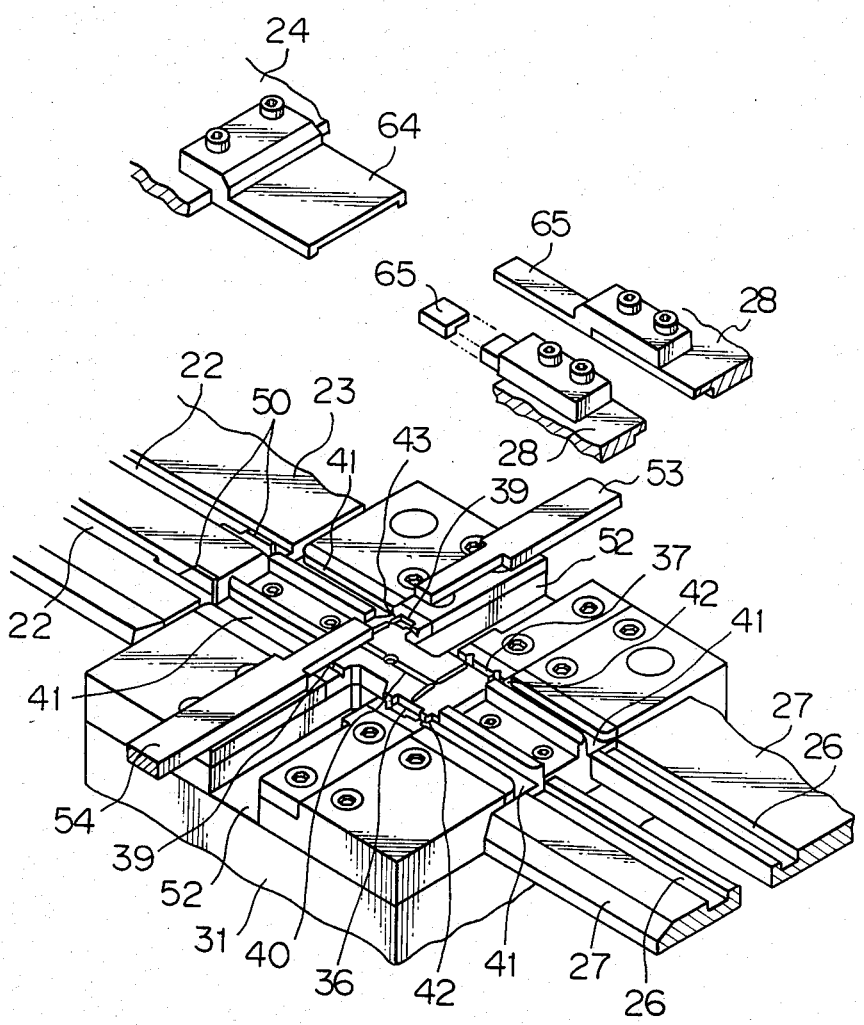
FIG. 3 is a perspective view of the apparatus shown in FIG. 1, which shows in detail the vicinity of its injection molding station.

A stringer guide device 21 is provided between the stringer separating device 5 and the injection molding station 7. The device 21, as shown in FIG. 3, has a guide plate 23 which is formed with fastener element guide passages 22, and a stringer holder 24 which covers the respective upper surfaces of the fastener element trains 14 within the guide passages 22. The guide plate 23 and the stringer holder 24 are vertically movable as one unit in such a manner that the unit is capable of selectively taking an upper conveying position and a lower injection molding position. A stringer guide device 25 (see FIG. 1) is similarly provided between the injection molding station 7 and the stringer re-combining device 6. As shown in FIG. 3, the guide device 25 has guide plates 27 which are respectively formed with fastener element guide passages 26, and stringer holders 28. The guide plates 27 and the stringer holders 28 perform the same actions as those of the corresponding members which constitute the guide device 21. The members which constitute the guide device 25 are, however, laterally separated for the purpose of accommodating a runner removing device, described later, in the space defined therebetween.

Figure 4:
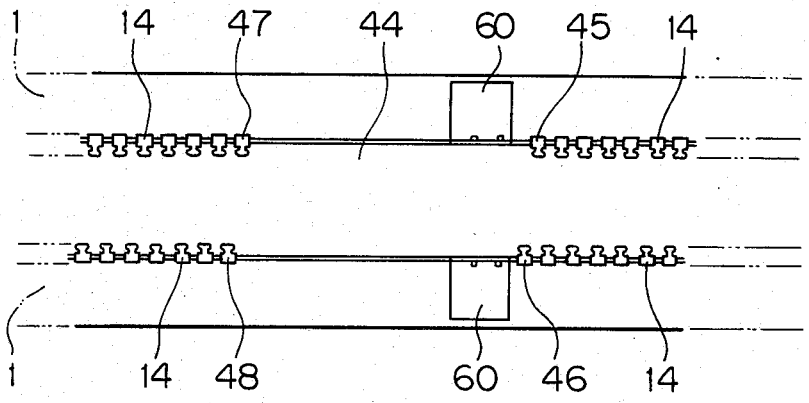
FIG. 4 is a plan view of fastener stringers before their respective pins and upper stops are formed by injection molding.
Figure 7:
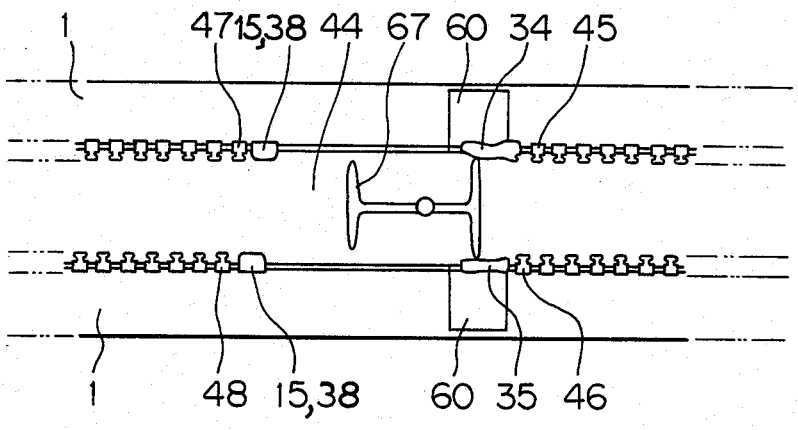
FIG. 7 is a plan view of the stringers after injection molding has been carried out.

As clearly shown in FIG. 3, the injection molding station 7 includes a lower die 31 and an upper die 32 (see FIG. 2). The lower die 31 has cavities 36, 37, 39 and a runner 40 which communicates with these cavities. The cavities 36, 37 are provided for respectively forming pins 34, 35 (see FIG. 7) which constitute a separable end stop, while the cavities 39 are provided for respectively forming upper stops 15 (see FIG. 7). The lower die 31 further has fastener element guide passages 41 which respectively communicate with their associated cavities. The guide passages 41 are located at the same height as that of the guide passages 22 and 26 at the time when the guide plates 23 and 27 are at the injection molding position, that is, the lower position. The cavities 36, 37, 39 have stoppers 42, 43 which are respectively formed close to their outer ends. The stoppers 42, 43 effect positioning of the stringers 1 in such a manner that, when a portion of each of the tapes which respectively constitute the stringers 1 is bent at a space portion 44 (see FIG. 4) as described later, the stoppers 42, 43 respectively engage with end fastener elements 45, 46, 47, 48 at opposite ends of the space portion 44 such as to prevent these elements from moving toward the center of the injection molding station 7 and thereby effecting positioning of the stringers 1. These stoppers may be arranged in any desired form, provided that they are immovable relative to the injection molding station 7 in terms of the moving direction of the stringers 1.

The upper die 32 is also provided with cavities and a runner for forming the pins and the upper stops in such a manner that the cavities and the runner respectively correspond to those of the lower die 31. The upper die 32 further has a sprue 49 which is formed such as to communicate with its runner. The sprue 49 is communicable with a nozzle 51 of an injection molding machine.

The lower die 31 is further provided with recesses 52 in its center in such a manner that arms 53, 54 can be lowered into the respective recesses 52. The arms 53, 54 are respectively connected to air cylinders 55, 56 in such a manner that the arms 53, 54 are vertically movable by the actions of the associated air cylinders 55, 56.

As shown in FIG. 2, the guide device 21 is provided at a portion thereof with a space sensor 58 which constitutes a part of a stringer positioning device. The space sensor 58 has a sensor lever 59, a spring 61 and a microswitch 62. The sensor lever 59 has sensor end portions 50 (see FIG. 3) which repsectively project into the fastener element guide passages 22 respectively formed in the guide plate 23. The spring 61 is disposed such as to bias the sensor lever 59 in the direction in which its sensor end portions 50 respectively project into the guide passages 22. The microswitch 62 detects displacement of the sensor lever 59 which occurs when it is disengaged from the fastener element trains 14.

The following is a description of the operation of the above-described apparatus according to the present invention.

Figure 6A:
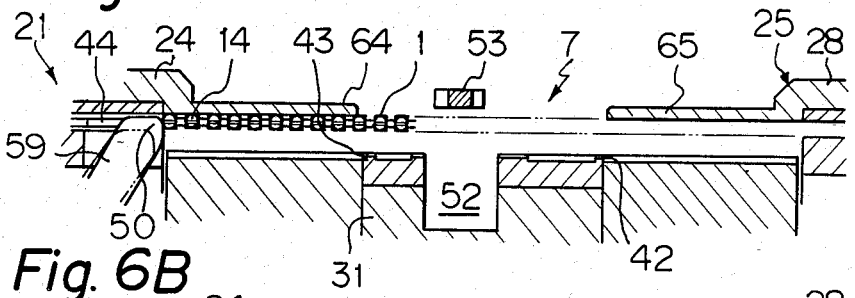
FIGS. 6A to 6E are vertical sectional views of the injection molding station showing the operations of the apparatus according to the present invention in the order in which they take place in the process.
Figure 6B:
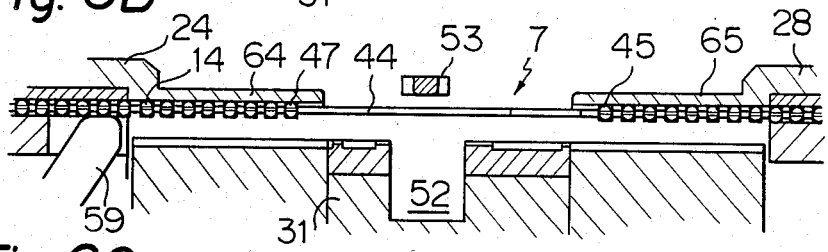

The pair of interengaged fastener stringers 1 which have been fed through the pair of guide rollers 2 and the tension roller 3 are separated from each other by the wedge member 9 and are then fed to the injection molding station 7 while their respective fastener element trains 14 are being guided by the corresponding fastener element guide passages 22 in the stringer guide device 21. In the course of this feeding operation, when the space portion 44, in which there are no fastener elements 14, reaches the position of the sensor end portions 50 of the sensor lever 59 constituting a part of the space sensor 58, the sensor lever 59 pivots in such a manner as to cause the microswitch 62 to generate a space sensing signal (see FIG. 6A). This signal actuates a timer device or distance measuring device of desired type (not shown) in such a manner that the conveyor device 4 is suspended after a predetermined period of time has elapsed from the time when the space portion 44 has been sensed, or after the stringers 1 have been moved over a predetermined distance. Thus, the space portion 44 is positioned in the center of the injection molding station 7 (see FIG. 6B).

Figure 6C:
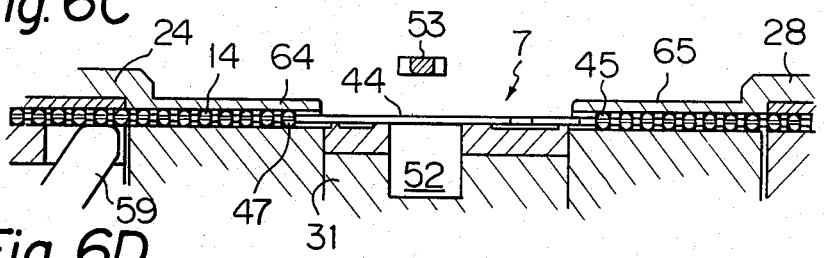

Next, the stringer holders 24, 28 lower together with the associated guide plates 23, 27 until the respective fastener element guide passages 22, 26 become equal in height to the corresponding fastener element guide passages 41 of the lower die 31. The stringer holders 24, 28 are respectively provided with extended portions 64, 65 which press the corresponding fastener element trains 14 against the associated fastener element passages 22, 27 (see FIG. 6C). Each of the rollers constituting the conveyor device 4 is arranged such as to become reversible when it is released from the driving force applied thereto. Accordingly, under this state, the portion of each of the stringers 1 which is on the downstream side of the injection molding station 7 is able to return to the injection molding station 7. Also, the portion of each of the stringers 1 on the upstream side of the injection molding station 7 is able to move toward the injection molding station 7 by the upward movement of the tension roller 3. Then, the air cylinders 17, 18 are actuated such as to move the stringer separating and recombining devices 5, 6, respectively, toward the injection molding station 7, whereby it is possible for the stringers 1 to be drawn toward the injection molding station 7.

Figure 6D:
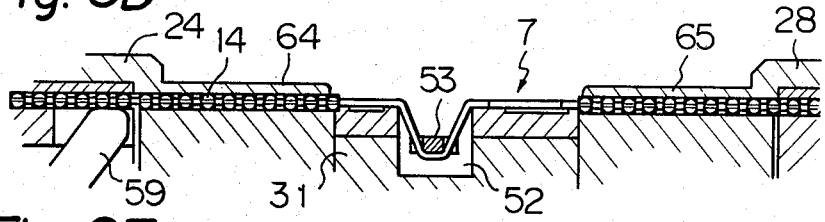

Next, the air cylinders 55, 56 are actuated such as to lower the arms 53, 54, respectively, thus causing a portion of each of the stringers 1 to be bent independently. By so doing, the stringers 1 are drawn toward the center of the injection molding station 7 until the end fastener elements 45, 46, 47, 48 at the opposite ends of each space portion 44 are respectively retained by the associated stoppers 42, 43 of the lower die 31 (see FIG. 6D). It is to be noted that the stroke of each of the air cylinders 55, 56 is set to be large enough to ensure that the movement of the stringers 1 is not terminated before the fastener elements 45, 46, 47, 48 are properly retained by the associated stoppers 42, 43, thereby allowing a proper degree of pushdown force to act on the arms 53, 54 even after the above-described fastener elements have been retained by the associated stoppers.

Figure 6E:
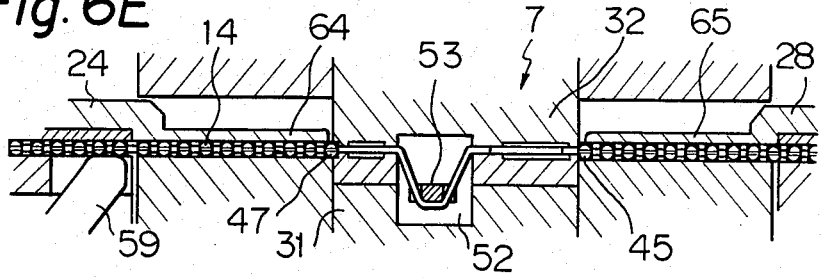
Figure 8:
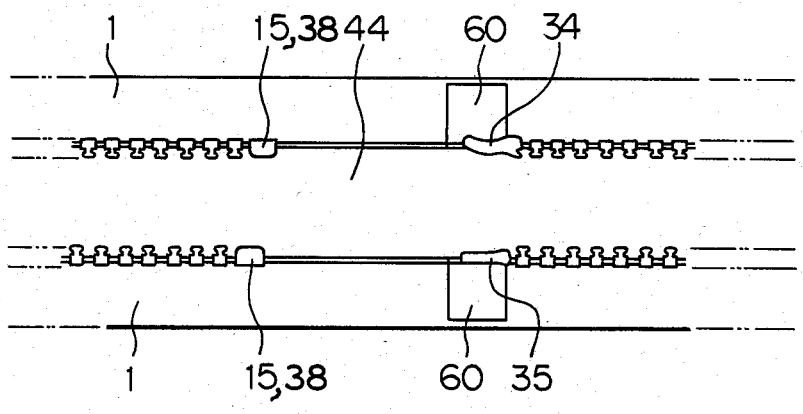
FIG. 8 is a plan view of the stringers after the runner has been removed therefrom.
Figure 9:
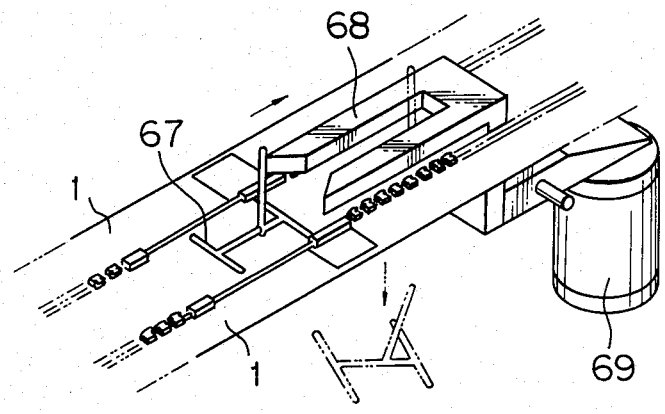
FIG. 9 is a perspective view of a runner removing device employed in the apparatus according to the present invention.

Then, the upper die 32 is lowered in such a manner that the upper and lower dies 32, 31 are clamped together (see FIG. 6E), thereby injection-molding pins 34, 35, which constitute a separable end stop, on pieces 60 of reinforcing tape which have previously been attached on the respective stringers 1 by a known method. At the same time, and in a similar manner, upper stops 38 are injection-molded on the respective stringers 1 on the other side of the space portion 44. Thereafter, the upper die 32 and the guide devices 21, 25 are returned to their previous positions, and the stringer separating and re-combining devices 5, 6 are also returned to their previous positions. Then, the feeding operation by the conveyor device 4 is resumed. In this case, the arrangement may be such that the degree of adhering strength between a runner 67 produced as a result of molding, the pins 34, 35 and the upper stops 38 is selected beforehand so that, when the stringers 1 which have been drawn toward the injection molding station 7 are stretched at the time of restarting the feeding operation of the conveyor device 4, the runner 67 comes off the upper stops 38 while maintaining its adherence to the pins 34, 35. Alternatively, the arrangement may be such that the runner 67 comes off the upper stops 38 while its adherence to the pins 34, 35 is maintained when the stringers 1 which have been drawn toward the injection molding station 7 are stretched by effectively varying the timing at which the upper die 32 and the guide devices 21, 25 start to return to their previous positions (see FIG. 7). The runner 67 may be removed by any desired method. According to the illustrated embodiment, as shown in FIG. 9, runner cutting edges 68 are provided in such a manner that they are selectively plunged into the area between the stringers 1 on the downstream side of the injection molding station 7 by the action of an air cylinder 69. After the runner 67 has been removed by the cutting edges 68 (see FIG. 8), the stringers 1 are fed to the stringer recombining device 6 where they are re-engaged with each other.

Figure 10:
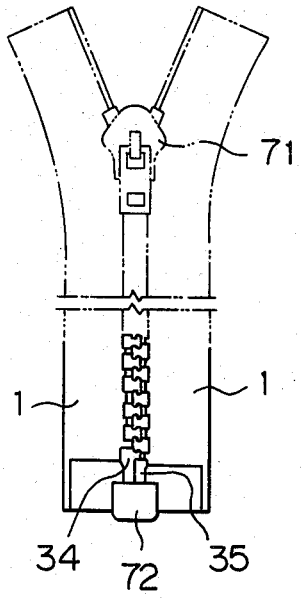
FIG. 10 is a plan view of a completed slide fastener with a separable end stop.

The stringers 1 re-combined together as described above are fed out from the conveyor device 44 and are then equipped with a slider 71 as shown in FIG. 10 by a known method. The re-combined stringers 1 are then cut at the space portion 4 and equipped with a box 72 which is secured to one (a box pin) of the pins 34, 35, thus becoming a complete slide fastener with a separable end stop.

What is claimed is:

1. In an apparatus for manufacturing a slide fastener with a separable end stop, including:

a conveyor device for conveying engaged stringers of continuous length which have space portions disposed at intervals in their longitudinal directions;

a stringer separating device for separating said engaged stringers as they are moved, and a stringer recombining device for re-engaging the separated stringers;

an injection molding station for molding upper stops and pins which constitute a separable end stop at both ends, respectively, of each of said space portions, said station being provided between said stringer separating and re-combining devices; and a positioning device which suspends said conveyor device when sensing one of said space portions in such a manner that the sensed spaced portion is stopped at said injection molding station, an improvement characterized by comprising:

a device for independently bending a portion of a tape which constitutes each of said stringers at said space portion within said injection molding station; and stoppers provided such as to be immovable relative to said injection molding station in terms of the moving direction of said stringers, said stoppers respectively engaging with end fastener elements at the opposite ends of said space portion while said bending operation is being effected, thereby positioning said fastener elements.

2. An apparatus for manufacturing a slide fastener with a separable end stop according to claim 1, wherein said conveyor device is arranged such as to allow said stringers to be moved backwardly when the conveying operation by said conveyor device is at rest.

3. An apparatus for manufacturing a slide fastener with a separable end stop according to claim 2, wherein said stringer separating and re-combining devices are movable toward said injection molding station.

* * * * *